United States Patent [19]

Winter

[11] Patent Number: 4,887,814

[45] Date of Patent: Dec. 19, 1989

[54] GAME BALL

[75] Inventor: Benjamin J. Winter, Oakland, Calif.

[73] Assignee: Winter Design/Manufacturing, Inc., Pleasanton, Calif.

[21] Appl. No.: 247,666

[22] Filed: Sep. 22, 1988

[51] Int. Cl.[4] ..... A63B 43/02

[52] U.S. Cl. ..... 273/65 EE; 273/65 EG; 273/65 EF; 273/58 K

[58] Field of Search ..... 273/65 EG, 65 ED, 65 EE, 273/65 EG, 65 R, 65 E, 58 A, 58 K, DIG. 020

[56] References Cited

U.S. PATENT DOCUMENTS

| | | | |
|---|---|---|---|
| D. 235,794 | 7/1975 | Kroener | 273/65 R |
| 1,150,761 | 8/1915 | Hartman | 273/58 K |
| 1,931,429 | 10/1933 | Buckner et al. | 273/65 EG |
| 2,194,674 | 3/1940 | Riddell | 273/65 EG |
| 2,270,553 | 1/1942 | Potito | 273/65 EG |
| 2,859,040 | 11/1958 | Gow et al. | 273/65 EG |
| 2,866,644 | 12/1958 | Gow et al. | 273/65 EG |
| 4,772,020 | 9/1988 | Martin | 279/65 EG |

*Primary Examiner*—George J. Marlo

*Attorney, Agent, or Firm*—Kolisch, Hartwell & Dickinson

[57] ABSTRACT

A ball for throwing by an individual in sport and recreational activities is defined by a body, preferably formed in the shape of a football, of resilient, elastically-deformable material having channels associated therewith helically generated to be wound around the ball substantially from one end to the other for receiving and enhancing purchase between an individual's fingers, received within the channels, and the ball when it is gripped.

10 Claims, 1 Drawing Sheet

GAME BALL

BACKGROUND AND SUMMARY OF THE INVENTION

The present invention relates generally to sporting goods, and more particularly to a ball provided with a novel configuration defined by a surface contoured with finger-receiving grooves or channels for enhancing grip by an individual.

The use of balls for playing sports or otherwise engaging in recreational activities doubtless has ancient origins. It is known that the classic Maya in Mexico utilized balls made of rubber in a game somewhat similar to present-day basketball. Ancient Europeans used balls formed of inflated animal bladders in various games simulating staged wars In any case, balls which are used in outdoor activities can become wet or otherwise slippery, impeding secure gripping by an individual. In sports such as football, which are played outdoors, rain and snow can cause recurring problems in ball handling.

Additionally, it can become difficult to maintain purchase between one's fingers and a ball in activities of purely recreational nature, i.e., on the beach, seashore, in a swimming pool, etc. Various proposals have been made suggesting modifications to balls, including footballs, to increase the friction between one's hand and a ball. The problem is particularly relevant in connection with a football, because the ball must be accurately and precisely gripped for throwing passes, executing handoffs, laterals, etc.

An example of a prior art football having means for improving grip is Buckner, et al., U.S. Pat. No. 1,931,429, which discloses a football having circumferentially-spaced and spirally-designed grooves filled with an abrasive material. The idea is that the fingers engage the grooves, which extend generally transversely to the fingers when the ball is held, thereby supposedly helping the grip.

Another football having a plurality of ribs, also positioned for extending generally transversely to one's fingers is disclosed in Gow, et al., U.S. Pat. No. 2,866,644. In U.S. Pat. No. 2,859,040, also issued to Gow, et al., another ribbed construction is disclosed. Further examples of footballs provided with means for increasing the ability for gripping in inclement weather are Riddell, U.S. Pat. No. 2,194,674 and Kroener, U.S. Pat. No. Des. 235,794.

Each of the above references discloses some type of rib or groove filled with abrasive material, provided on a football, for positioning transversely to one's fingers to increase one's ability to grip the ball. There are other methods for increasing grip, i.e., "pebbled" surfaces on balls, etc. However, none of the above methods have been found to be particularly effective, and particularly in situations where the ball may become very wet, such as in a swimming pool.

Additionally, none of the above devices provides any means for enabling a football to be immediately gripped and oriented in the "ready" position for throwing. Stated differently, conventional footballs must be manipulated in one's hands into a proper position prior to throwing a pass, such as a spiral pass. The specially contoured surface of the present invention ensures proper hand and finger orientation, as will be described.

With the above disadvantages of the prior art in mind, it is a general object of the present invention to provide a novel ball construction for throwing by individuals in sport and recreational activities which includes a body formed of resilient, elastically-deformable material with channel means provided on the body for receiving one's fingers and enhancing purchase when the ball is gripped.

Specifically, it is another object of the present invention to provide a ball, formed generally ellipsoidal in the shape of a football, wherein channel means defined by a plurality of adjacently-positioned individual channels are provided on the ball. The channels are elongate, and dimensioned with a width approximating generally that of a finger so that the longitudinal axis of one's fingers may be aligned generally along a portion of the length of an associated channel. The channels are contoured on the surface of the ball to define individual helical paths generated to be wound around the ball substantially from one end to the other. The result is a ball which provides channels defining grooves in which one's fingers may readily seat and be snugly held, in an optimal orientation to be assumed by an individual when gripping a football prior to throwing.

Another object of the present invention is to provide a ball, as described above, in which the channels are configured with resilient side ribs for engaging and firmly holding a finger within an associated channel, thereby further enabling a positive grip.

These and additional objects and advantages of the present invention will be more readily understood after a consideration of the drawings and the detailed description of the preferred embodiment.

DETAILED DESCRIPTION OF THE PREFERRED EMBODIMENT

As mentioned at the outset, a general object of the present invention is to provide a ball which has a surface with contoured, finger-receiving channels for enhancing grip, and in particular channels which are spirally or helically wound around the ball, such as a football, enabling the fingers to normally seat therewithin. The use of channels may be provided readily on other shapes of balls; however, the following description is directed to the provision of channels in accordance with applicant's invention as they are contoured on a football.

Figure 1:
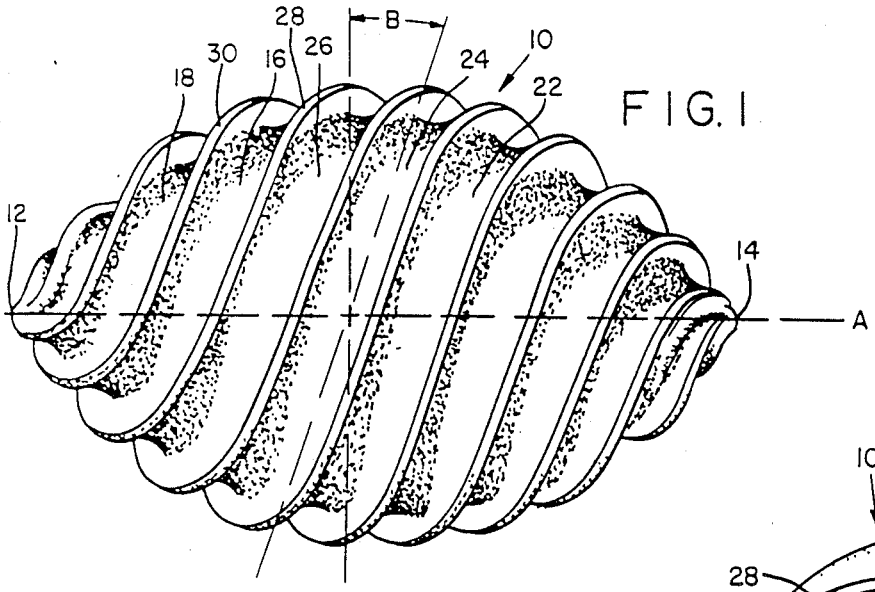
FIG. 1 is a side elevational view of a ball in accordance with the present invention.
Figure 2:
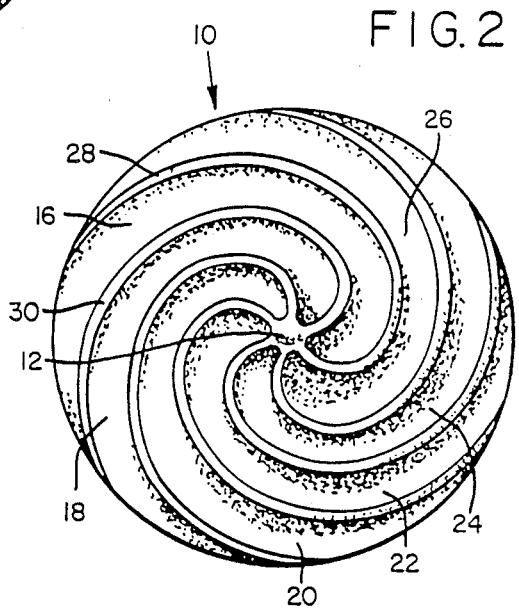
FIG. 2 is an end view of the ball shown in FIG. 1.
Figure 3:
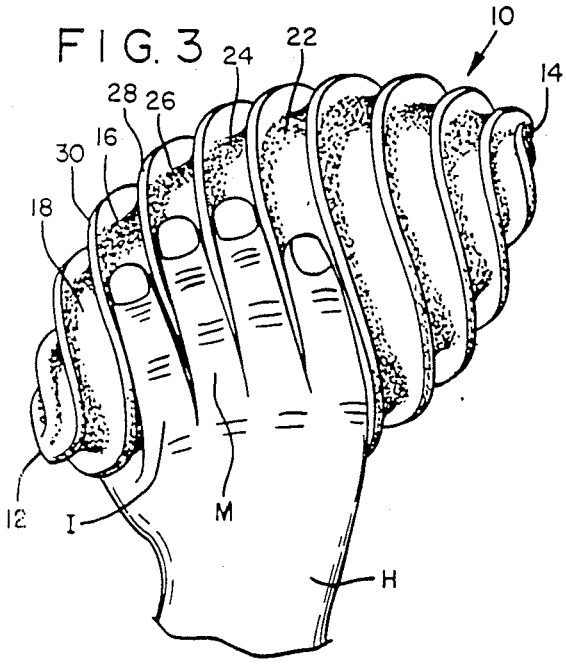
FIG. 3 is a view of the ball illustrating gripping by an individual so that the fingers are disposed within the finger-receiving channels.

As shown in FIG. 1, a ball 10 includes a body configured generally ellipsoidal in the shape of a football having opposed ends indicated at 12, 14. The body is formed of foam material or other suitable resilient, elastically-deformable material. As shown in FIGS. 1–3, ball 10 includes channel means associated therewith for receiving and enhancing purchase between an individual's fingers and the ball when it is gripped. Specifically, as shown in FIGS. 1–3, the channel means are defined by a plurality of adjacently-positioned individual channels, such as indicated at 16, 18, 20, 22, 24 and 26.

Figure 4:
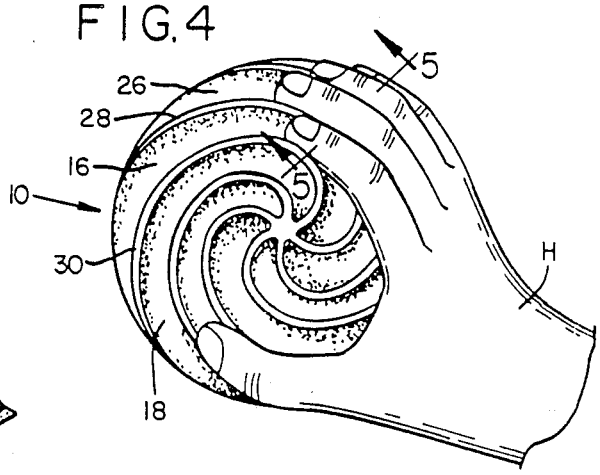
FIG. 4 is an end view of the ball showing gripping by an individual prior to throwing.
Figure 5:
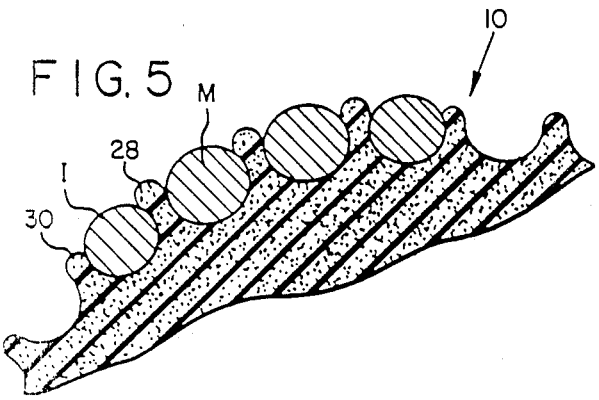
FIG. 5 is a cross-sectional view taken along lines 5—5 of FIG. 4 showing positioning of the fingers within channels formed in the ball.

Each of the channels is elongate in form and dimensioned with a width approximating generally that of a human finger so that the longitudinal axis of a finger may be aligned generally along a portion of the length of an associated channel, such as shown in FIG. 3. The channels are formed to receive separately each of an individual's fingers substantially along their respective lengths. Each of the channels is configured with resilient side ribs, for example, channel 16 is bordered with upstanding ribs 28, 30. Thus, as shown in FIGS. 3–5, when an individual's fingers are positioned for reception within associated channels, the ribs serve to orient the fingers and hold them in position.

As shown in FIG. 3, an individual's hand H is positioned with the fingers snugly received in associated channels in the orientation normally preferred by an individual when gripping a football prior to throwing. The first or index finger I is shown received within channel 16, the middle finger M is shown received within channel 26, etc. FIG. 5, which is a cross-sectional view taken along lines 5—5 of FIG. 4, shows the fingers received within the channels illustrating further the resilient side ribs, such as ribs 28, 30.

Because the ball is made of elastomeric material, such as foam rubber or the like, deformation of the ball, upon squeezing of one's hand, causes the ribs to further engage and hold the fingers. Stated differently, and viewing FIG. 5, it can be seen that if the ball is squeezed, ribs 28, 30 will tend to be urged against finger I, along its length, thereby further increasing ball-finger purchase. It is virtually impossible for the fingers to slip relative to longitudinal axis A of the ball.

Returning to the side view of the ball of FIG. 1, it is noted that the channels are disposed at an angle generally in the range of 0°–45° relative to an axis perpendicular to the longitudinal axis of the ball. That angle, preferably around 20°, is indicated at B in FIG. 1. By so disposing the helical channels which are wound around the ball, one may automatically have one's fingers oriented into the correct position for imparting spiral flight to the ball. Moreover, if the ball is tossed to an individual, it may be caught so that the fingers readily slide into the channels as shown in FIG. 3. While other finger positions may be realized, i.e., the hand may be moved further toward end 14 than shown, the result essentially is the same: the fingers are oriented in a predetermined manner corresponding precisely to the way one would grip a football.

In the prior art mentioned at the outset, grooves or ribs are provided on various footballs which extend transversely to an individual's fingers. However, in the present invention, the idea is that the channels, such as indicated at 16–26, are spirally or helically generated from one generatrix or end 12 to the opposite end 14 at an angular orientation corresponding to how one would normally grip a football for throwing a spiral pass.

From the above description, it should be apparent that there are several important and distinct advantages of the present invention. The ball may be readily formed as a one-piece construction either as a scaled-down version of a football or in regulation size. As a scaled-down version, the ball may have an overall length of approximately nine inches with a width of five inches. Such a ball may be readily used for recreation in swimming pools, on the beach, etc. Because of the provision of at least six channels, which are spirally or helically wound along the length of the ball, one may readily experience enhanced fingerball purchase, with the added benefit of the fingers being prepositioned in proper orientation for throwing.

Additionally, because the body of the ball is formed of resilient material, the side ribs which define the sides of each channel, also being of resilient material, are urged inwardly against a finger to further increase purchase when the body of the ball is squeezed. It will be noted from FIGS. 2 and 4 that the helical grooves spiral from end 12 in what may be thought of as a counterclockwise direction. Obviously, the spirals could be provided in a reverse or clockwise direction if desired, i.e., a ball for left-handers.

Another important advantage of the ball of the present invention resides in its enhanced capability of being caught, even by relatively young children. Provision of the ribs and associated grooves defines an irregular or non-smooth surface which enables the ball to be more readily caught after it has been thrown. The ribs contact one's fingers and hands and provide a friction surface which greatly facilitates catching.

While the above invention has been shown and described with reference to the foregoing preferred embodiment, it will be appreciated by those skilled in the art that other changes in form and detail may be made therein without departing from the spirit and scope of the invention as defined in the appended claims.

It is claimed and desired to secure by Letters Patent:

1. A ball for throwing by an individual in sport and recreational activities comprising:

a body formed of resilient, elastically-deformable material, and having channel means integrally formed in an outer surface of the body for receiving each of an individual's fingers substantially along their respective lengths for enhancing purchase between the individual's fingers and the body when the ball is gripped.

2. The ball of claim 1 wherein the body is configured generally ellipsoidal in the shape of a football with opposed ends, the channel means being defined by a plurality of adjacently-positioned individual channels, each configured for receiving a finger therewithin.

3. The ball of claim 2 wherein each channel is elongate and dimensioned with a width approximating generally that of a finger so that the longitudinal axis of a finger may be aligned generally along a portion of the length of an associated channel.

4. The ball of claim 3 wherein the channels are contoured on the body to define individual helical paths generated around at least a portion of the length of the ball.

5. The ball of claim 4 wherein the channels are each helically generated to be wound around the ball substantially from one end to the other.

6. The ball of claim 5 wherein the channels are configured with resilient side ribs for engaging and firmly holding a finger within an associated channel.

7. The ball of claim 6 wherein the channels are helically wound around the ball to accommodate reception of the fingers in an orientation normally assumed by an individual's hand when gripping a football prior to throwing.

8. The ball of claim 7 wherein the side ribs are configured for increased biasing against fingers received within an associated channel when the body is squeezed by the fingers.

9. The ball of claim 8 wherein the longitudinal axis of the channels, when the ball is viewed from the side, are disposed at an angle in the range of 0°–45° relative to an axis perpendicular to the longitudinal axis of the ball.

10. A ball for throwing by an individual in sport and recreational activities comprising:

a body formed of resilient, elastically-deformable material configured generally ellipsoidal in the shape of a football with opposed ends, and having channel means integrally formed in an outer surface of the body for receiving each of an individual's fingers substantially along their respective lengths for enhancing purchase between the individual's fingers and the body when the ball is gripped, the channel means being defined by a plurality of adjacently-positioned individual channels helically generated to be wound around the ball substantially from one end to the other, each of the channels being dimensioned with a width approximating generally that of a finger so that the longitudinal axis of a finger may be aligned generally along a portion of the length of an associated channel.

* * * * *